US006786687B1

(12) United States Patent
Schroeder

(10) Patent No.: US 6,786,687 B1
(45) Date of Patent: Sep. 7, 2004

(54) DUNNAGE BAR PIVOT ASSEMBLY

(75) Inventor: Robert C. Schroeder, Northport, MI (US)

(73) Assignee: William G. Fuller, New Hudson, MI (US)

( * ) Notice: Subject to any disclaimer, the term of this patent is extended or adjusted under 35 U.S.C. 154(b) by 0 days.

(21) Appl. No.: 10/219,698

(22) Filed: Aug. 15, 2002

(51) Int. Cl.[7] ..... B60P 7/15
(52) U.S. Cl. ..... 410/43; 410/143
(58) Field of Search ..... 410/43, 143, 32, 410/34, 121; 211/162, 41.1, 94.02; 411/513; 384/275, 906

(56) References Cited

U.S. PATENT DOCUMENTS 4,558,979 A * 12/1985 Andrews ..... 410/101
4,705,422 A * 11/1987 Tsui et al. ..... 403/60
4,815,905 A * 3/1989 Garcia, Jr. ..... 410/34
5,037,256 A * 8/1991 Schroeder ..... 410/143
5,378,093 A 1/1995 Schroeder
5,582,495 A 12/1996 Schroeder
6,146,068 A * 11/2000 Schroeder ..... 410/35

FOREIGN PATENT DOCUMENTS

JP 353023488 * 3/1978 ..... 410/32

* cited by examiner

*Primary Examiner*—D. Glenn Dayoan
*Assistant Examiner*—H. Gutman
(74) *Attorney, Agent, or Firm*—Reising, Ethington, Barnes, Kisselle, P.C.

(57) ABSTRACT

A shipping assembly is provided in which a dunnage bar is pivotally mounted on a shipping frame. A bushing is non-rotatably mounted adjacent to an end of a swing arm on the dunnage bar. A pivot pin has a cylindrical shank that extends through a cylindrical opening in the bushing into a cylindrical opening in a collar secured to the frame. A pin extends laterally through aligned openings in the collar and the pivot pin to mount the pivot pin non-rotatably to the frame, so that the dunnage bar and swing arm are free to pivot about the shank of the pivot pin with respect to the collar and the frame.

9 Claims, 2 Drawing Sheets

DUNNAGE BAR PIVOT ASSEMBLY

The present invention is directed to a dunnage shipping assembly that includes a dunnage bar pivotally mounted on a shipping frame, and more particularly to an improved pivot arrangement between the dunnage bar and the shipping frame.

BACKGROUND OF THE INVENTION

Applicant's U.S. Pat. Nos. 5,378,093 and 5,582,495 disclose dunnage frame and bar assemblies in which a dunnage bar subassembly is pivotally mounted on a shipping frame for movement between an open position in which the dunnage may be added to or withdrawn from the frame, and a closed position in which the bar locks the dunnage in position on the frame. The dunnage bar assembly includes a dunnage bar, a latch at each end of the bar for releasably securing each end of the bar to the frame in at least the closed position, and a pair of swing arms extending radially from respective ends of the bar. Shoulder bolts extend through the ends of the swing arms remote from the bar, and through corresponding openings in the frame, for pivotally mounting the dunnage bar assembly to the frame. However, it has been found that, if the shoulder bolts are not properly tightened, the weight and forces on the swing arm can be applied to threads on the shoulder bolts, undesirably weakening the assembly. It is therefore an object of the present invention to provide an improved pivot arrangement of general utility, but with particularly advantageous application to pivotal swing arms in dunnage locking arrangements of the described character, and which addresses the aforementioned problem in the prior art.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

The disclosures of above-noted U.S. Pat. Nos. 5,378,093 and 5,582,495 are incorporated herein by reference for purposes of background.

Figure 1:
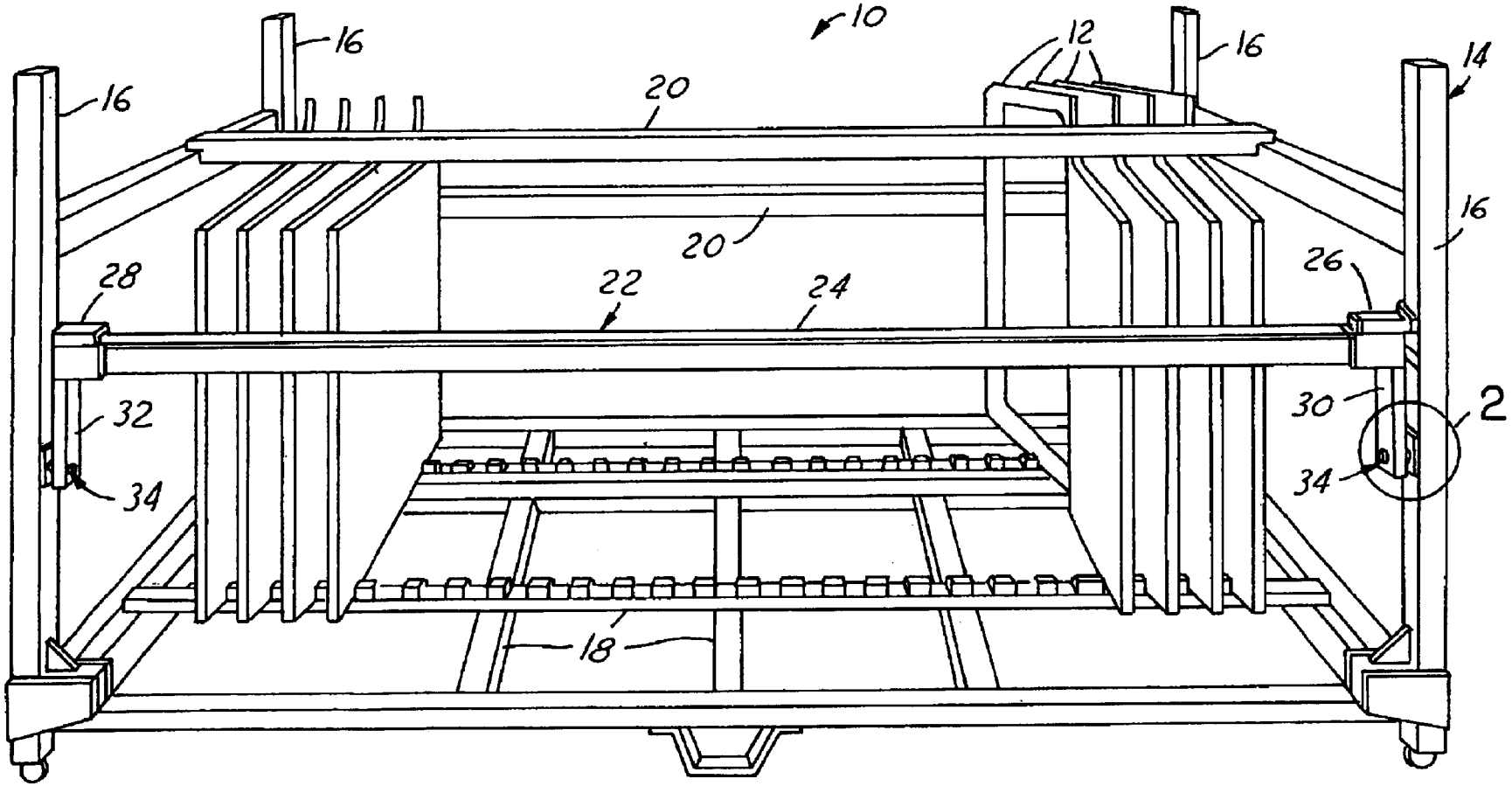
FIG. 1 is a front perspective view of a shipping frame for automotive door panels having a pivotal dunnage bar assembly in accordance with an exemplary presently preferred embodiment.

FIG. 1 illustrates an assembly 10 for shipping automotive door panels 12 in an exemplary implementation of the present invention. Assembly 10 includes a generally rectangular frame 14 having corner members or posts 16, a bed 18, and a number of dunnage bars 20, 22. At least one dunnage bar 22 is movable between a closed position illustrated in FIG. 1 locking panels 12 in place on bed 18, and an open position for permitting addition or removal of panels 12. Dunnage bar 22 is provided in the form of an assembly that preferably includes an elongated tubular bar 24, a pair of latches 26, 28 at opposed ends of bar 24 for releasable latching to spaced posts 16, and a pair of swing arms 30, 32 extending radially from the opposed ends of bar 24. Each swing arm 30, 32 is pivotally mounted to an adjacent post 16 by means of a bushing assembly 34 in accordance with the present invention.

Figure 2:
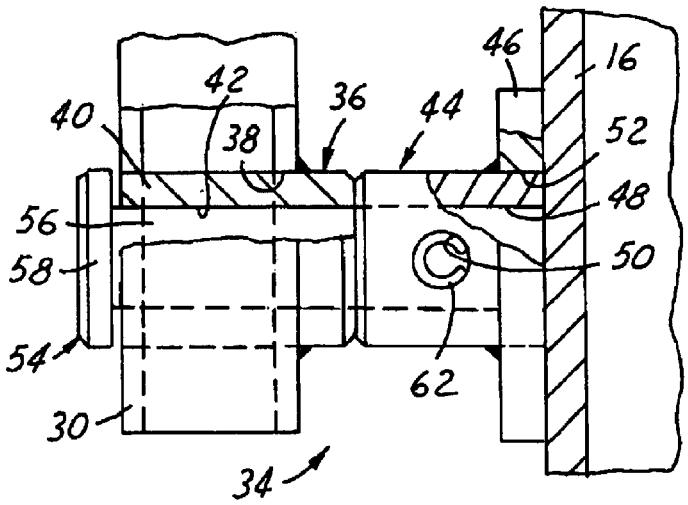
FIG. 2 is a partially sectioned elevational view on an enlarged scale of the portion of FIG. 1 within the area 2.
Figure 3:
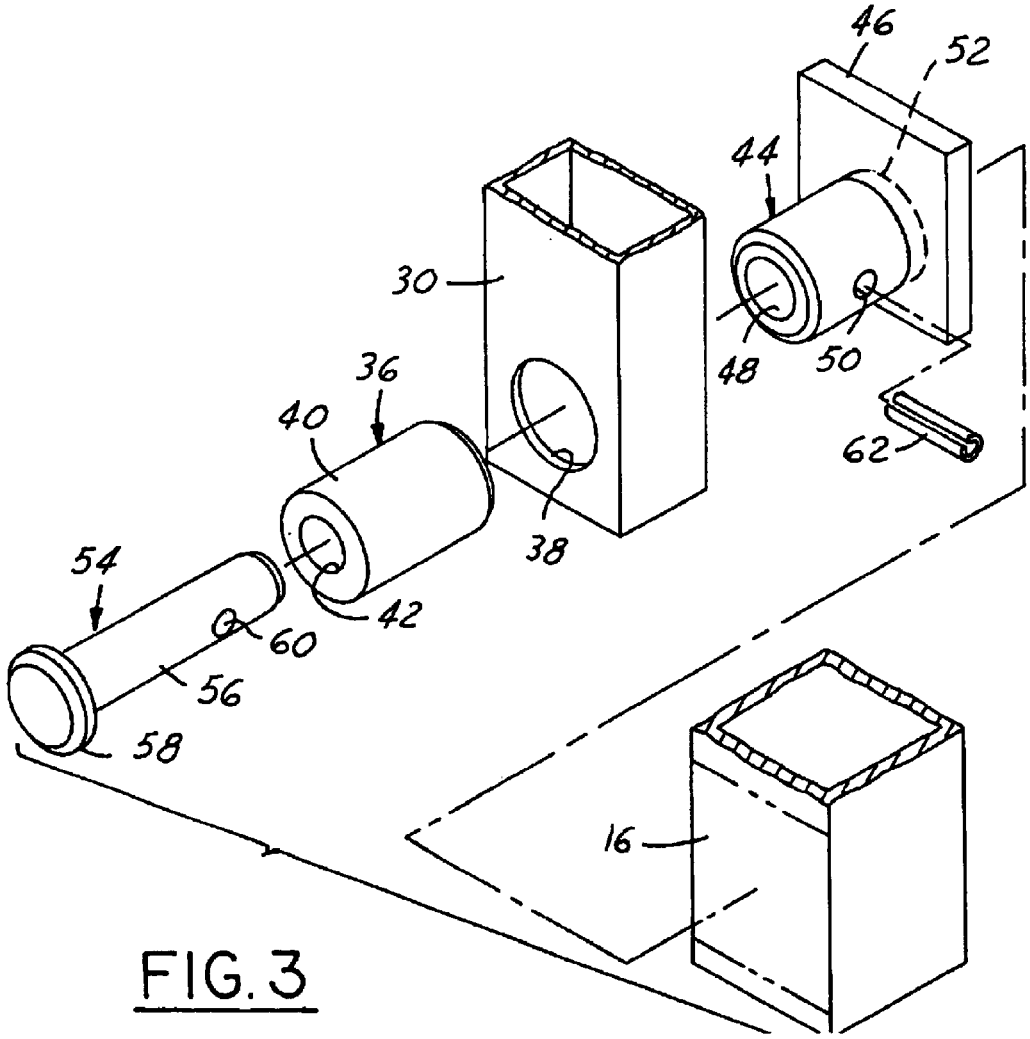
FIG. 3 is a fragmentary exploded perspective view of the dunnage bar pivot assembly in the embodiment of FIGS. 1 and 2.

Referring now to FIGS. 2–3, bushing assembly 34 in the illustrated embodiment of the invention includes a bushing 36 received and secured within an opening 38 adjacent to an end of swing arm 30 (or 32) remote from bar 24 (FIG. 1). Bushing 36 includes a body 40 through which a cylindrical opening 42 axially extends. Bushing body 40 preferably is of annular cylindrical construction. As best seen in FIG. 2, bushing body 40 extends through opening 38, and is welded or otherwise fixedly secured to swing arm 30. A bushing or collar 44 is secured to frame post 16, preferably by being welded to a collar support plate 46 that is itself welded or otherwise secured to post 16. Collar 44 has a cylindrical first opening 48 extending axially through the collar (and preferably at 52 through support plate 46), and a second opening 50 extending laterally through the collar transverse to first opening 48. Plate 46 has an opening 52 (FIG. 2) that is aligned with collar 44 in assembly.

A pivot pin 54 has a cylindrical shank 56 and an enlarged head 58. An opening 60 extends transversely through shank 56 adjacent to an end of the shank remote from head 58. Pivot pin shank 56 extends in assembly through opening 42 in bushing 40 and opening 48 in collar 44, and transverse opening 60 in pivot pin shank 56 aligns with lateral opening 50 in collar 44. A roll pin 62 removably extends through aligned openings 50, 60 non-rotatably to secure pivot pin 54 to collar 44, and thus to plate 46 and frame 14. Openings 48 in collars 44 are coaxially aligned on the opposed sides of frame 14 (FIG. 1) and bushings 36 on bar swing arms 30, 32 are axially aligned in assembly. Thus, swing arm assembly 22 is free to pivot about the aligned axes of pivot pins 54.

Dunnage bar assembly 22 may be provided as a subassembly by a supplier for mounting on a shipping frame 14 by the frame manufacturer. Bushing 36 in such an implementation may be secured by the subassembly manufacturer, while pivot pins 54, roll pins 62 and collars 44 mounted on plates 56 would be provided separately for assembly to the frame, and assembly of the dunnage bar to the frame, by the frame manufacturer. The pivot assembly of the present invention is also adapted for retrofit into existing shipping frame assemblies employing shoulder bolts as pivot elements, as disclosed in the above-noted U.S. patents. The external geometries of bushings 36 and collars 44 are illustrated as cylindrical for commercial convenience, but may be of any suitable geometry. Likewise, pivot pin 54 may be non-rotatably secured to collar 44 by any suitable means, roll pin 62 being particularly preferred for reasons of economy and ease of disassembly if needed.

There have thus been disclosed a shipping assembly, a dunnage bar assembly and a bushing assembly for mounting a swing arm on a frame, that fully satisfy all of the objects and aims previously set forth. The invention has been disclosed in conjunction with an exemplary but presently preferred embodiment thereof, and a number of modifications and variations have been discussed. Other modifications and variations will readily suggest themselves to persons of ordinary skill in the art. The invention is intended to embrace all such modifications and variations as fall within the spirit and broad scope of the appended claims.

What is claimed is:

1. A shipping assembly that includes a frame for carrying dunnage and having at least one frame member, a dunnage bar having at least one arm, and a pivot assembly for pivotally mounting said arm to said frame, wherein said pivot assembly includes:

a bushing non-rotatably mounted adjacent to an end of said arm, said bushing having a cylindrical through opening, a pivot pin having a cylindrical shank extending through said bushing opening, a collar non-movably secured to said frame member, said collar having a cylindrical first opening for receiving an end of said pivot pin shank and a second opening transverse to said first opening, said shank of said pivot pin having a transverse opening for alignment with said second opening in said collar, and means extending through said second opening in said collar and into said opening in said shank non-rotatably securing an end of said pivot pin to said collar and said frame member, such that said arm is mounted on said pivot pin through said bushing and pivotal on said shank with respect to said frame member.

2. The shipping assembly set forth in claim 1 wherein said collar is of annular cylindrical construction, with said cylindrical first opening extending axially through said annular cylindrical construction and said second opening extending laterally into said annular cylindrical construction.

3. The shipping assembly set forth in claim 2 wherein said means extending through said second opening comprises a removable pin.

4. The ship assembly set forth in claim 2 wherein said collar is non-movably secured to a plate and said plate is non-movably secured to said frame member.

5. A dunnage bar assembly that includes:

a bar having spaced ends, means adjacent to each end of said bar for releasably latching each said end of said bar to a dunnage support frame, a pair of swing arms respectively extending from said bar, each said swing arm having a first end affixed to said bar and a second end spaced from said bar, and means on each said swing arm for pivotally mounting said second end of said swing arm to the frame, so that said swing arms and said bar are pivotable as a unit with respect to the frame about an axis parallel to said bar and are defined by said pivotally mounting means, said pivotally mounting means including:

a bushing non-rotatably mounted adjacent to an end of each said arm, said bushings having cylindrical through openings that are aligned with each other on said axis, a pair of pivot pins having cylindrical shanks coaxial with each other and with said axis, said shanks extending through respective ones of said bushing openings, a pair of collars adapted to be non-movably secured to the frame, said collars having cylindrical first openings aligned with each other on said axis for receiving ends of respective pivot pin shanks, and respective said openings transverse to said first openings, said shank of each said pivot pin having a transverse opening for alignment with said second openings in said collars, and means extending through each said second opening in said collar and into said opening in said shank.

6. The assembly set forth in claim 5 wherein said means extending through said second openings comprise removable pins.

7. The dunnage bar assembly set forth in claim 5 wherein each said collar is of annular cylindrical construction, with said cylindrical first opening extending axially through said annular cylindrical construction and said second opening extending laterally into said annular cylindrical construction.

8. The assembly set forth in claim 7 wherein said collars are each non-movably secured to a plate and said plates are adapted to be non-movably secured to said the frame.

9. The assembly set forth in claim 7 wherein each said pivot pin further includes an enlarged head disposed opposite to each other on insides of said arms.

* * * * *